United States Patent [19]

Furukawa et al.

[11] Patent Number: 4,500,478

[45] Date of Patent: Feb. 19, 1985

[54] SUPPORTING APPARATUS FOR CARBURETOR CONTROLLING CAM PLATE

[75] Inventors: Nobuyuki Furukawa, Asaka; Mitsuhiro Sanbe, Kiyose, both of Japan

[73] Assignee: Honda Giken Kogyo Kabushiki Kaisha, Tokyo, Japan

[21] Appl. No.: 537,807

[22] Filed: Sep. 30, 1983

[30] Foreign Application Priority Data

Oct. 5, 1982 [JP] Japan ..... 57-174744

[51] Int. Cl.[3] ..... F02M 1/10

[52] U.S. Cl. ..... 261/52; 261/DIG. 74; 251/133; 123/361

[58] Field of Search ..... 261/52, DIG. 74; 123/361, 339, 336, 340, 435; 251/133

[56] References Cited

U.S. PATENT DOCUMENTS

| | | | |
|---|---|---|---|
| 3,575,389 | 4/1971 | Goto et al. | 261/52 |
| 3,687,415 | 8/1972 | Turkot | 251/133 |
| 3,964,457 | 6/1976 | Coscia | 123/361 |
| 4,161,994 | 7/1979 | Collonia | 123/361 |
| 4,321,902 | 3/1982 | Stoltman | 261/52 |
| 4,351,782 | 9/1982 | Bellicardi et al. | 261/52 |
| 4,383,510 | 5/1983 | Nakamura et al. | 123/361 |

FOREIGN PATENT DOCUMENTS

| | | | |
|---|---|---|---|
| 2525594 | 12/1976 | Fed. Rep. of Germany | 261/52 |
| 54-40930 | 3/1979 | Japan | 261/52 |

*Primary Examiner*—Tim Miles

*Attorney, Agent, or Firm*—Posnack, Roberts, Cohen & Spiecens

[57] ABSTRACT

A carburetor includes a choke valve and a throttle valve, a controlling prime mover and a driving shaft rotated by the prime mover. First and second cam plates are provided for controlling the opening of the choke valve. A third cam plate is provided for controlling the opening of the throttle valve. Each cam plate is supported on the driving shaft. A displacement detection plate is also mounted on the driving shaft for detecting rotational displacement of the cam plates. A phase shift preventing arrangement locks together the cam plates for the choke valve, the cam plate for the throttle valve and the displacement detection plate to avoid relative phase shift between the same.

16 Claims, 6 Drawing Figures

SUPPORTING APPARATUS FOR CARBURETOR CONTROLLING CAM PLATE

BACKGROUND OF THE INVENTION

1. Field of the Invention

The present invention relates to carburetors and more particularly to supporting apparatus for carburetor controlling cam plates.

2. Description of the Prior Art

A conventional type of carburetor may have a choke valve cam plate, a throttle valve cam plate and the like supported on a driving shaft driven and rotated by a control prime mover. Therein the choke valve is controlled for opening by the choke valve cam plate and the throttle valve is controlled for opening by the throttle valve cam plate. The choke valve cam plate and the throttle valve cam plate are supported on the driving shaft and are rotatable together with the driving shaft. However, the driving shaft is not always sufficiently perfect in its supporting function as to prevent a relative phase shift between the choke valve cam plate and the throttle valve cam plate. In such case, it becomes difficult to control the choke valve and the throttle valve for opening with sufficiently great precision.

SUMMARY OF THE INVENTION

A principal object of the present invention is to provide a supporting apparatus for a carburetor controlling cam plate which will prevent a relative phase shift between the associated choke valve cam plate and throttle valve cam plate, thereby to control the opening of choke and throttle valves with great precision.

As will be seen in greater detail hereinafter, there is provided in accordance with the invention an apparatus for supporting cam plates for controlling a carburetor. These cam plates may include, for example, a choke valve cam plate, a throttle valve cam plate and/or a displacement detection plate. The cam plates are supported on a driving shaft in turn driven and rotated by a control prime mover. The cam plates rotate with the shaft. As will also be seen, the cam plates are mutually fixed by a phase shift preventing arrangement so as to avoid an undesirable phase shift.

The above and other objects, features and advantages of the invention will become more apparent hereinafter from the following detailed description as illustrated in the accompanying drawing.

DETAILED DESCRIPTION

A carburetor embodying the present invention will now be described in detail with reference to the accompanying drawings.

Figure 1:
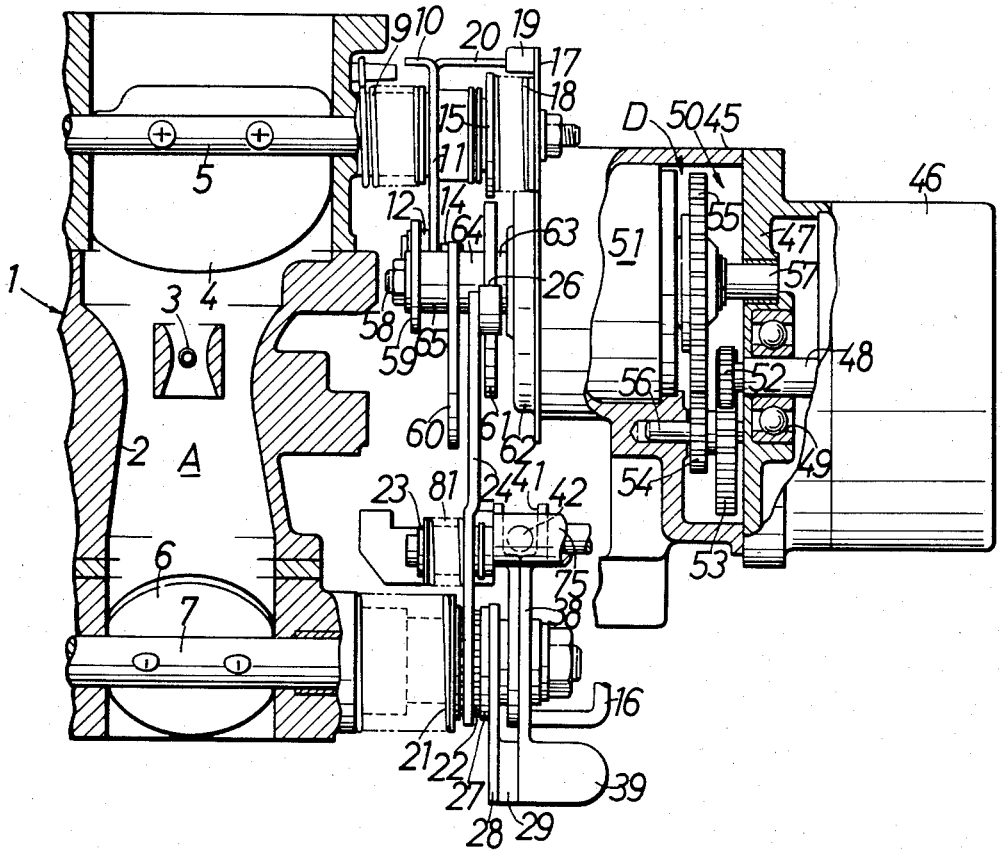
FIG. 1 is a front view, partly in section, of a portion of a carburetor provided in accordance with one preferred embodiment of the present invention.
Figure 2:
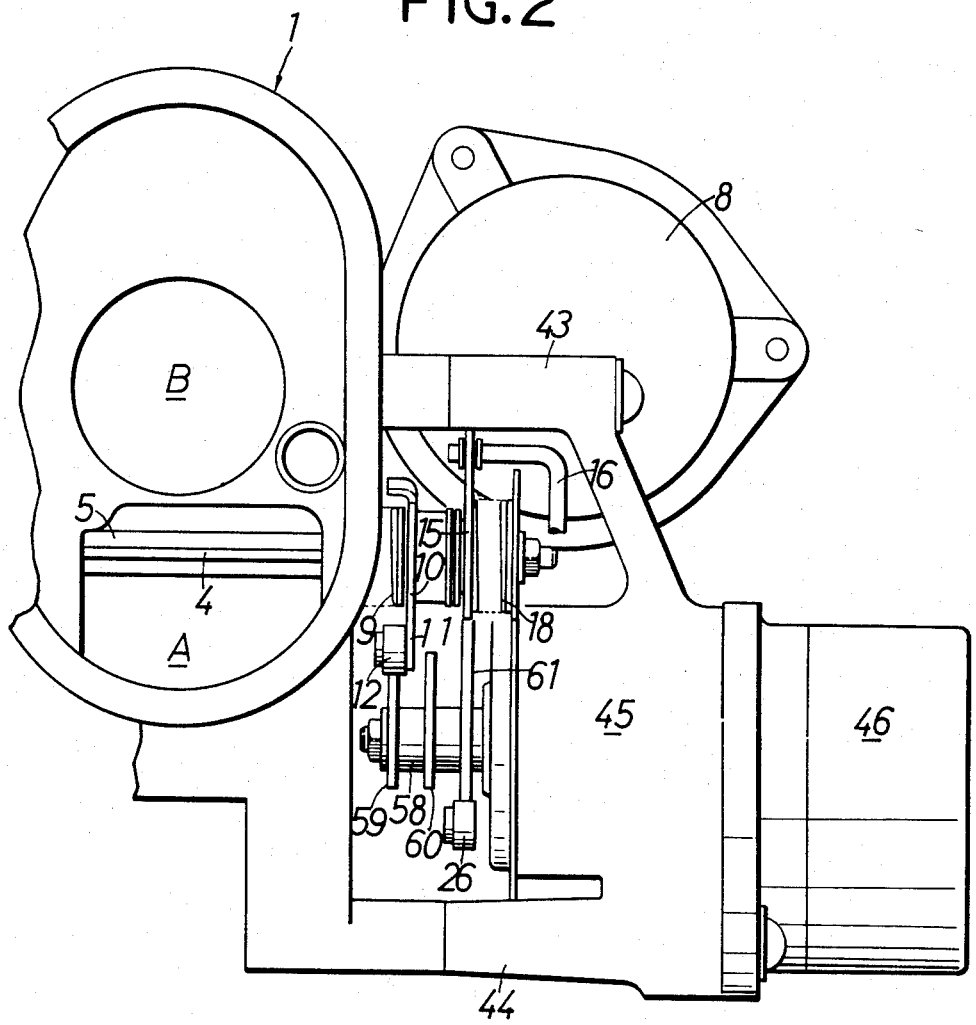
FIG. 2 is a plan view of the carburetor of FIG. 1.
Figure 3:
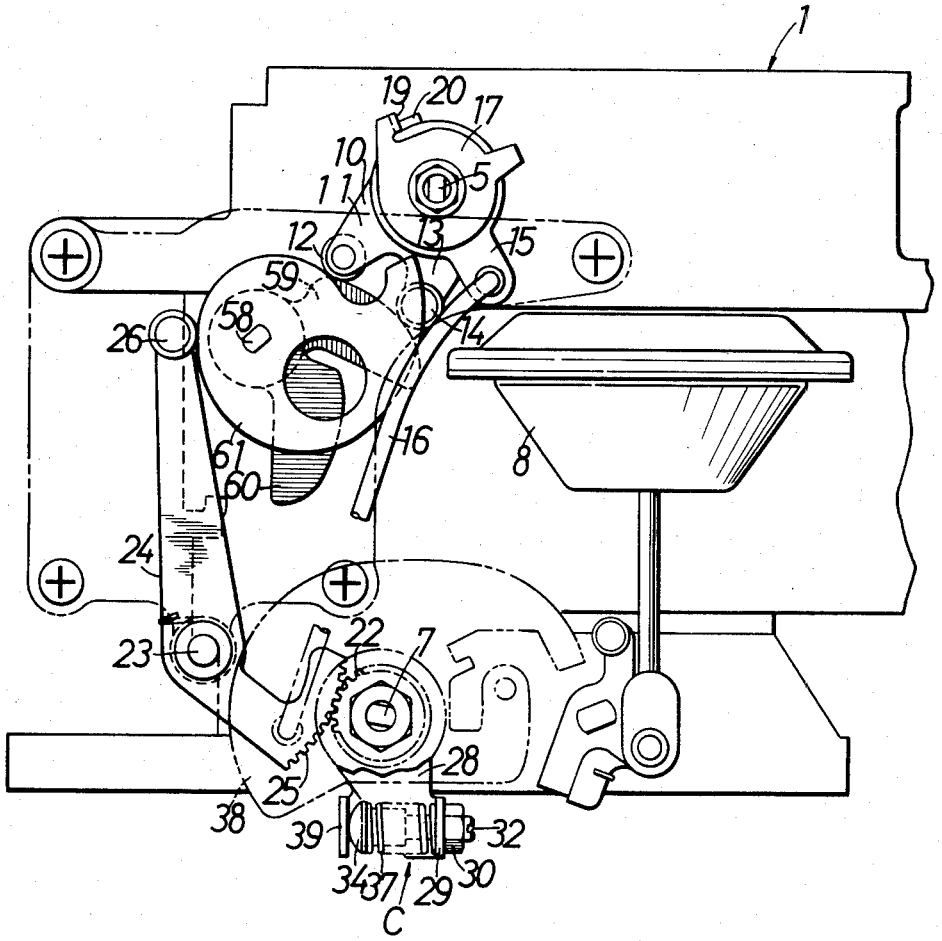
FIG. 3 is a side view, partly in section, of the carburetor of FIG.1.

Referring first to FIGS. 1–3, the apparatus therein includes a fuel nozzle 3 disposed at the center of a Venturi part 2 formed in an intake passage A of a carburetor 1. A choke valve 4 is carried on a choke valve shaft 5 at the upstream of the fuel nozzle 3, and a throttle valve 6 is carried on a throttle valve shaft 7 at the downstream side of the fuel nozzle 3. A secondary intake passage B (FIG. 2) is formed adjacent the intake passage A and a secondary throttle valve in the secondary intake passage B is controlled for operation by a secondary throttle valve switch 8. A secondary air-fuel mixture is fed into the combustion chamber of an engine in accordance with a high-speed rotation of the associated engine (not shown), thereby improving the charging efficiency of the associated cylinders. The supplementary feeder for the secondary air-fuel mixture which includes the secondary intake passage B and secondary throttle valve switch 8 is well known and has nothing to do with the present invention. Therefore no further description will be given in this regard.

The choke valve shaft 5 is eccentric with respect to the center of the choke valve 4. When the choke valve 4 closes, a suction or negative pressure of the engine operates on the choke valve 4 as a torque tending to open the valve. The choke valve shaft 5 extends outwardly of the intake passage A and, on the portion of the choke valve shaft 5 extending outwardly of the intake passage A, there is disposed a return spring 9. Spring 9 gives the choke valve shaft 5 a bias or turning force to urge the choke valve 4 to open towards a maximum open position. An oscillating plate 10 is also provided having an integral driven arm 11 provided with a roller 12. The roller 12 follows the cam face of a first cam plate 59 described hereinafter. Plate 10 also has a driven arm 13 provided with a roller 14 to follow the cam face of a second cam plate 60 also described later. This transmits a turning force to a choke lever 17 via claw 19 thereon by means of a claw 20 on plate 10 which is provided rotatably on the choke valve shaft 5. A turning plate 15 pivotably carries one end of an interlocking link 16 which moves longitudinally according to oscillations of a throttle lever to be described later. Plate 15 turns integrally with the choke valve shaft 5 due to its being fixed on the choke valve shaft 5. The choke lever 17, as noted above, has the claw 19 to come into contact with the claw 20 of the oscillating plate 10. Lever 17 is fixed on the choke valve shaft 5. A bias spring 18 has one end abutting the claw 20 and the other end abutting the choke lever 17 and giving a resilient force in a direction such that the claws 20 and 19 are urged into contact with each other at all times.

The throttle valve shaft 7 also extends outwardly of the intake passage A. On the portion of the throttle valve shaft 7 extending outwardly of the intake passage A, there is disposed a return spring 21 to give a bias or turning force to a gear 22 mounted on the throttle valve shaft 7. The turning force is counter-clockwise in FIGS. 3 and 4. The spring 21 has its one end stopped on the outer wall surface of the intake passage A and the other end stopped on the gear 22. The gear 22 is mounted on the throttle valve shaft 7 so as to rotate relatively with respect to the throttle valve shaft 7. Gear 22 engages with a segment gear 25 (FIG. 3) formed on a driven arm 24 pivoted intermediate its extremities on a pivot 23 to be described later. Arm 24 is provided with a roller 26 intended to follow the cam face of a third cam plate 61 to be described later. A throttle drive lever 28 is provided on the throttle valve shaft 7 so as to rotate relatively with respect to the throttle valve shaft 7. Lever 28 is fixed to the gear 22 through a spacer 27 so as to oscillate integrally with the gear 22. A throttle lever 38 has a stop 40 whereat one end of a throttle wire 42 is engaged as illustrated particularly in FIG. 4. Lever 38 also has a guide groove 41 for guiding the throttle wire 42 as illustrated in FIG. 1. Lever 38 is fixed on the throttle valve shaft 7 so as to rotate the throttle valve shaft 7 in the direction of increasing the opening of the throttle valve 6. This is clockwise in FIGS. 3 and 4, against the force of a return spring (not shown) when a tensile force works on the throttle wire 42, and when the end counter to the turning plate 15 of the interlocking link 16 is pivoted as shown in FIG. 3.

Figure 4:
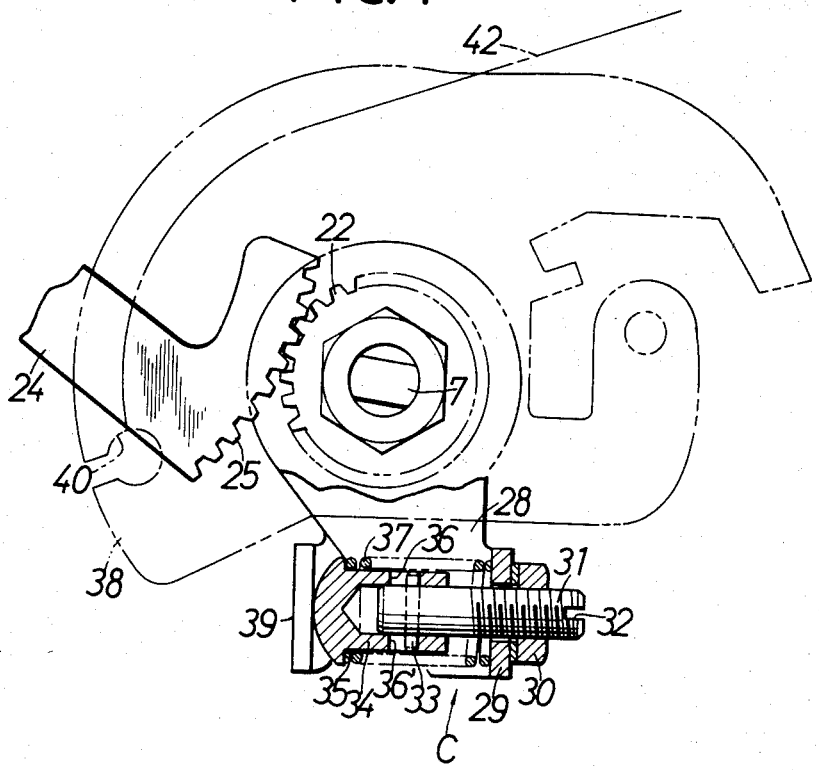
FIG. 4 is an enlarged view, partly in section, of a portion of FIG. 3.

In FIGS. 1, 3 and 4, the throttle drive lever 28 oscillates around the throttle valve shaft 7 due to interlocking with a controlling prime mover 46 to be described later and which operates according to a control input signal. This regulates an oscillation limit of the throttle lever 38 in the direction of decreasing the opening of the throttle valve 6. A shock absorber C is provided for cushioning collisions between the throttle lever 38 and the throttle drive lever 28. The shock absorber C is provided in a regulating force transmitting zone between the throttle lever 38 and the throttle drive lever 28 and is supported on at least one side of the throttle lever 38 and the throttle drive lever 28, or the side, for example, of the throttle drive lever 28 as illustrated.

In the shock absorber C, an adjusting screw 31 (FIG. 4) with a male screw formed on its base end is loosely fitted in a hole provided in a bend 29 formed on the tip of the throttle drive lever 28. An adjusting nut 30 is fitted to the screw portion projecting outwardly of the bend or claw 29. An adjusting slot 32, for engagement by a tool such as screwdriver or the like, is formed on the base end of the adjusting screw 31. The point of the adjusting screw 31 projects towards contact part or claw 39 on the throttle lever 38. A cylindrical contact segment 34 having a bevelled part 35 on its nose is fitted slidably at the point of the adjusting screw 31 in axial extension thereof. Slots 36 and 36' aligned axially of the contact segment 34 are formed in the body of the contact segment 34 at opposite diametrically positions. A pin 33 penetrates in a diametrical direction and is fixed near the point of the adjusting screw 31. Projections on both ends of the pin 33 engage the slots 36 and 36' of the contact segment 34. A spring 37 is interposed between the bevelled part 35 of the contact segment 34 and the bend 29. The contact segment 34 is retained on the point end of the adjusting screw 31 at all times by action of the spring 37.

In FIGS. 1 and 2, a transmission-unit outer frame 45 for supporting controlling prime mover 46 (consisting, for example, of a pulse motor) is supported on the outer wall of the intake passages A and B of the carburetor 1 through supporting arms 43 and 44. The interior of the controlling prime mover 46 and a transmission unit space D (surrounded by the transmission-unit outer frame 45) are partitioned from each other by a common wall or dissepiment 47. Output shaft 48 of the controlling prime mover 46 and gear shafts 56 and 57 of gears 53, 54 and 55 of a reduction gear train 50 in the transmission unit space D are all provided rotatably on a bearing formed within the common dissepiment 47. The output shaft 48 of the controlling prime mover 46 projects into the transmission unit space D through the bearing 49 in the common dissepiment 47. A gear 52 fixed on the end of the output shaft 48 projecting into the transmission unit space D engages with the gear 53 fixed on a gear shaft 56 having one end borne on a bearing which is located within the common dissepiment 47. Another gear 54 fixed on the gear shaft 56 engages with the gear 55 fixed on the gear shaft 57 borne in a bearing in the common dissepiment 47.

The controlling prime mover 46 consists, for example, of a pulse motor, which is driven and rotated according to a forwarding pulse or reversing pulse which is the output signal of an electronic controlling circuit (not shown) operating on input factors such as engine temperature detected through water temperature of the associated engine, rotational frequency of the engine and suction air temperature of the engine. The output torque is transferred to the input side of an electromagnetic clutch 51 mounted on the transmission unit outer frame 45.

Figure 5:
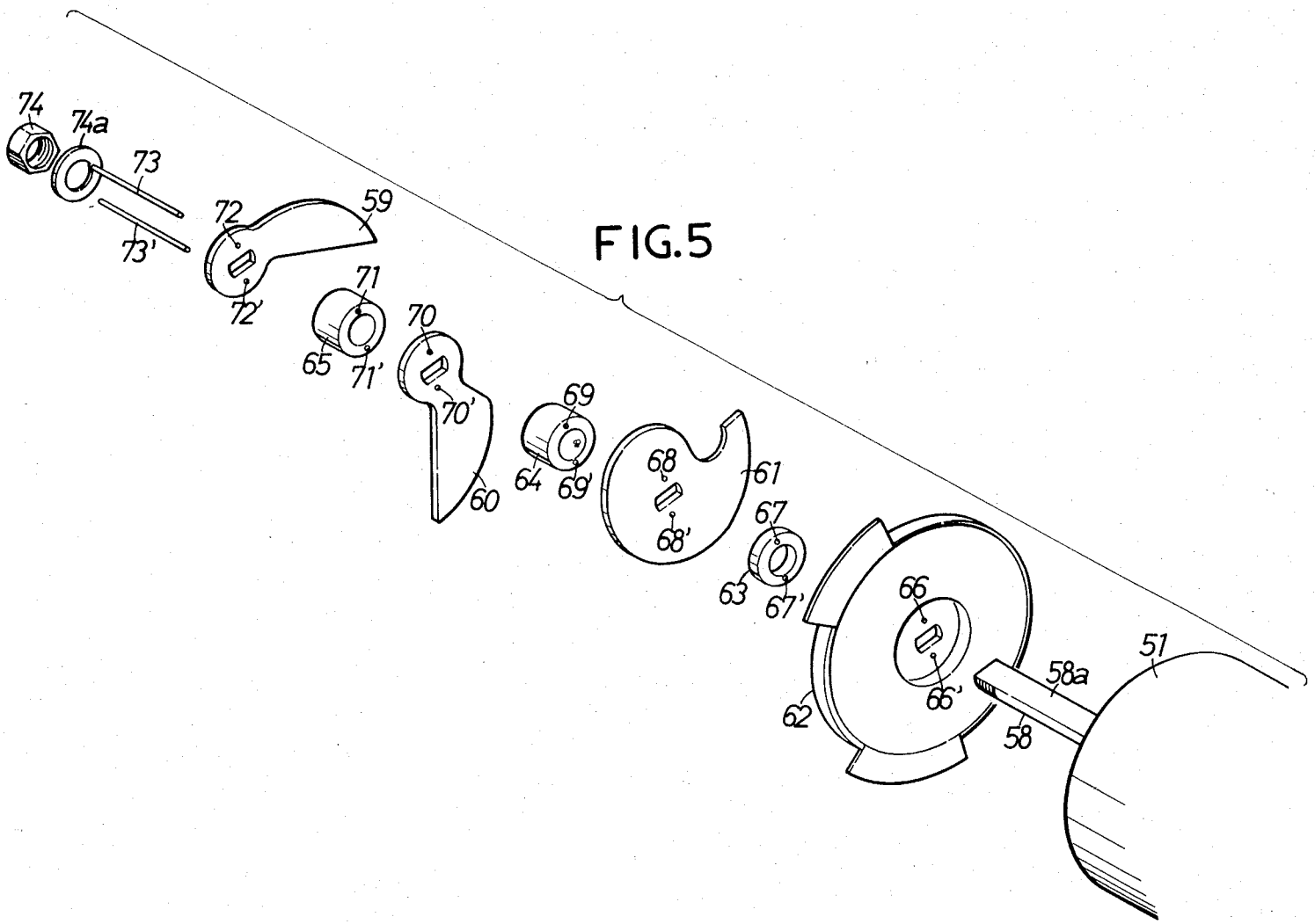
FIG. 5 is an exploded perspective view of a cam unit of FIG. 1.
Figure 6:
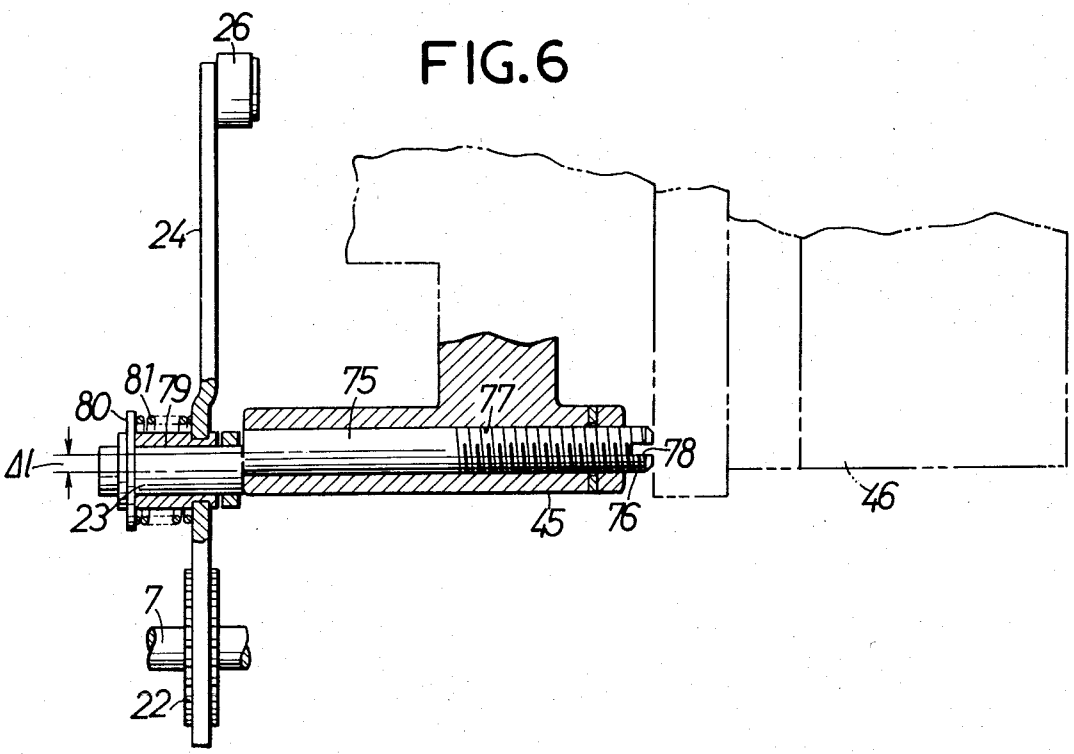
FIG. 6 is an enlarged view, partly in section, of a portion of FIG. 1.

As shown in FIGS. 1, 2 and 5, driving shaft 58, which is the output shaft of the electromagnetic clutch 51, projects in parallel with the choke valve shaft 5 and the throttle valve shaft 7. On the driving shaft 58, there are fitted a displacement detection plate 62 for detecting rotational displacement, a collar 63, third cam plate 61, a collar 64, second cam plate 60, a collar 65 and first cam plate 59. A flat zone 58*a* is formed on the driving shaft 58 corresponding at least to the displacement detection plate 62, the third cam plate 61, the second cam plate 60 and the first cam plate 59. The provision of the flat zone 58*a* on the driving shaft 58 is to provide for transmitting torque of the driving shaft 58 effectively to the displacement detection plate 62 and the cam plates 59, 60, 61.

A pair of pin insertion holes 66 and 66' are formed on the displacement detection plate 62 across the center hole therein. A pair of pin insertion holes 67 and 67' are also formed in the collar 63 at opposite positions in a diametrical sense. A pair of pin insertion holes 68 and 68' are furthermore formed in the third cam plate 61 across the center hole therein. A pair of pin insertion holes 69 and 69' are additionally formed in the collar 64 at opposite positions in a diametrical sense. Further, a pair of pin insertion holes 70 and 70' are formed in the second cam plate 60 across its center hole while a pair of pin insertion holes 71 and 71' are formed in the collar 65 at opposite positions in a diametrical sense. Also a pair of pin insertion holes 72 and 72' are formed in the first cam plate 59 across its center hole. An insertion pin 73 is inserted in the pin insertion holes 66, 67, 68, 69, 70, 71 and 72 and an insertion pin 73' is inserted in the pin insertion holes 66', 67', 68', 69', 70', 71' and 72'. These insertion pins 73 and 73' which are parallel to shaft 58 constitute a means for preventing relative phase shift between the cam plates 59, 60, 61 and the displacement detection plate 62 and also for performing cam control and displacement detection with great precision. With respect to the phase-shift preventing means, the cam plates 59, 60 and 61, and the displacement detection plate 62 can alternatively be calked and thus fixed so as to avoid any relative phase shift (instead of using the insertion pins 73, 73' as illutrated). Furthermore, a male screw can be formed on the tip of the driving shaft 58 and engaged by a clamp nut 74 to insure a tight installation of the cam plates 59, 60 and 61 and the displacement detection plate 62 on the driving shaft 58. A washer 74*a* locks pins 73 and 73' in position.

As shown in FIGS. 1 to 3, the first cam plate 59 is kept at an axial position corresponding to the roller 12 on the driven arm 11. The second cam plate 60 is kept at an axial position corresponding to the roller 14 on the driven arm 13. The third cam plate 61 is kept at an axial position corresponding to the roller 26 on the driven arm 24.

In FIGS. 1 to 3 and FIG. 6, a male screw 76 formed on one end of a rotatable shaft 75 postured in parallel with the throttle valve shaft 7. Screw 76 is fitted into a female screw 77 formed in the transmission-unit outer frame 45. An adjusting slot 78 (in which to engage a tool such as screwdriver or the like) is formed on the end surface of the shaft 75. The pivot 23 for the driven arm 24 is provided solidly on the turning shaft 75 in parallel with the turning shaft 75 with its center axis eccentric by a distance $\Delta l$ (FIG. 6) from the center axis of the turning shaft 75.

A cylindrical member 79 is fitted rotatably on the pivot 23, and the driven arm 24 is fixed on the cylindrical member 79. The driven arm 24 is subjected to a bias force clockwise, for example, in FIG. 3 by an action of a bias spring 81 having one end abutting an end plate 80 fixed on the tip of the pivot 23. The other end abuts the driven arm 24 so as to have a backlash for engagement of the segment gear 25 and the gear 22 in one direction at all times. Thus, the bias spring 81 constitutes a backlash-direction keeping mechanism for smooth engagement of the segment gear 25 and the gear 22. Then, when the turning shaft 75 is turned with a tool engaged in the adjusting slot 78, the pivot 23 is turned around the center axis of the turning shaft 75. The magnitude of backlash for inter-engagement of the segment gear 25 and the gear 22 is changed as a result. Therefore, the backlash for engagement of the segment gear 25 and the gear 22 can be adjusted by utilizing the adjusting slot 78. Especially, an eccentric shaft structure as exemplified by the turning shaft 75 and the pivot 23 constitutes a backlash adjusting mechanism.

Next, the action of the illustrated carburetor 1 will be described. First, at the time of initial idling or starting, the controlling prime mover 46 consisting, for example, of the above-mentioned pulse motor is driven for forward rotation. Torque of the controlling prime mover 46 is transferred to the driving shaft 58 by way of the reduction gear train 50 and the electromagnetic clutch 51. The driving shaft 58 is thus rotated counterclockwise in FIG. 3.

As the driving shaft 58 is rotated, the first cam plate 59, the second cam plate 60, the third cam plate 61 and the displacement detection plate 62 rotate integrally with the driving shaft 58. Since the first cam plate 59 and the second cam plate 60 are disposed with their phases shifted in the direction of rotation in this case, the cam face of the first cam plate 59 comes into contact with the roller 12 to turn the oscillating plate 10 clockwise in FIG. 3 through the driven arm 11, and consecutively the cam face of the second cam plate 60 comes into contact with the roller 14 to turn the oscillating plate 10 further clockwise in FIG. 3 through the driven arm 13. Consequently, the choke valve shaft 5 is rotated clockwise in FIG. 3 against the resilient force of the return spring 9 through operation of the claw 20, the bias spring 18, the claw 19 and the choke lever 17, thereby turning the choke valve 4 to a closed position.

Meanwhile, the cam face of the third cam plate 61 is kept in contact at all times with the roller 26 to move the driven arm 24 around the pivot 23 counterclockwise in FIG. 3. The segment gear 25 then rotates the gear 22 around the throttle valve shaft 7 clockwise in FIGS. 3 and 4 against a force of the return spring 21. In accordance with the rotation of the gear 22, the throttle drive lever 28 is moved together with the gear 22 around the throttle valve shaft 7 clockwise in FIGS. 3 and 4. The flange 29 of the throttle drive lever 28 then operates to depress contact part 39 of the throttle lever 38 through the shock absorber C. Thus, the throttle lever 38 is moved with the throttle valve shaft 7 clockwise in FIGS. 3 and 4 against the force of a return spring (not shown). Consequently, the throttle valve shaft 7 rotates integrally with the throttle lever 38 in clockwise direction in FIGS. 3 and 4, thereby opening the throttle valve 6 to a first idling opening position.

After the engine starts up, the suction or negative pressure operates on the choke valve 4 as an opening torque. When the opening torque increases more than the set twisting load of the spring 18, the choke valve 4 opens until the torsion force of the spring 18 comes to balance with the opening torque. This prevents the air-fuel mixture produced in the intake passage A from being thickened excessively.

After starting, the engine temperature rises. When it exceeds a set temperature value, the controlling prime mover 46 is driven to inversion, and thus the driving shaft 58 is rotated clockwise in FIG. 3 through the reduction gear train 50 and the electromagnetic clutch 51. The first cam plate 59, the second cam plate 60, the third cam plate 61 and the displacement detection plate 62 rotate together with the driving shaft 58 clockwise in FIG. 3. However, the oscillating plate 10 is subjected to a return force counterclockwise in FIG. 3 by the force of the return spring 9 through the choke valve shaft 5, the choke lever 17, the claw 19, the bias spring 18 and the claw 20. First, the following roller 14 is detached from the cam face of the second cam plate 60 and the following roller 12 moves along the cam face of the first cam plate 59. Thus, the choke valve shaft 5 rotates counterclockwise in FIG. 3, thereby increasing the opening of the choke valve 4.

In addition, the following roller 26 moves along the cam face of the third cam plate 61 and the driven arm 24 is oscillated around the pivot 23 clockwise in FIG. 3. The segment gear 25 then rotates the gear 22, subject to the force of the return spring 21 around the throttle valve shaft 7, counterclockwise in FIGS. 3 and 4. Thus, the throttle drive lever 28 oscillates around the throttle valve shaft 7, due to its being integral with the gear 22, counterclockwise in FIGS. 3 and 4. Consequently, the lever 38 oscillates counterclockwise in FIGS. 3 and 4 against the force of a return spring (not shown). The throttle valve shaft 7 is thus rotated counterclockwise in FIGS. 3 and 4, thus closing the throttle valve 6. to a normal idling position.

At the time of idling of an engine to which auxiliary equipment such as an air conditioning compressor or the like is connected as a load, the driving shaft 58 rotates further clockwise in FIG. 3 due to the controlling prime mover 46 being reversed in rotation. The third cam plate 61 is further rotated clockwise in FIG. 3 to oscillate the driven arm 24 counterclockwise around the pivot 23 in FIG. 3. The throttle valve shaft 7 is thus rotated clockwise in FIGS. 3 and 4 by operation of the gear 22, the throttle drive lever 28, the shock absorber C and the throttle lever 38. The throttle valve 6 is thus turned in the direction which results in increasing the opening.

For auto-cruising or constant-speed running, the carburetor 1 operates fundamentally as in the case of idling control. However, the opening of the throttle valve 6 is set to be larger than the opening at the time of idling control.

For normal drive, the throttle lever 38 is oscillated with the throttle valve shaft 7 by operation of the throttle wire 42 according to the driver's control. Thus the opening of the throttle valve 6 is controlled according to the driver's will. In this case, the shock absorber C functions as a stopper with respect to the contact member 39, and the throttle drive lever 28 sets the oscillation limit for the throttle lever 38 in the direction of decreasing the opening of the throttle valve 6. Oscillation of the throttle lever 38 in the direction of increasing the opening of the throttle valve 6 makes the turning plate 15 turn around the choke valve shaft 5 counterclockwise in FIG. 3. As a result, the opening of the choke valve 4 is increased so as to keep suction air quantity from being excessively small.

As described, according to this invention, a cam plate for choke valve, a cam plate for throttle valve and a displacement detection plate are supported on a driving shaft rotatably therewith, and also fixed to each other with a phase shift preventing means so as to prevent a relative phase shift from arising between them. Therefore, any relative phase shift between the cam plate for the choke valve, the cam plate for the throttle valve and the displacement detection plate can be positively prevented. Thus, the opening of the choke valve or throttle valve can be precisely controlled with great precision.

There will now be obvious to those skilled in the art many modifications and variations of the structure set forth above. These modification and variations will not depart from the scope of the invention if defined by the following claims.

What is claimed is:

1. Apparatus comprising a carburetor including a choke valve and a throttle valve, a controlling prime mover, a driving shaft rotated by said prime mover, first and second cam plates for controlling the opening of said choke valve, a third cam plate for controlling the opening of said throttle valve, each said cam plate being supported on said driving shaft, a displacement detection plate on said driving shaft for detecting rotational displacement of said cam plates, and a phase shift preventing means, said cam plates for the choke valve, said cam plate for the throttle valve and said displacement detection plate being fixed to each other by said phase shift preventing means so as to avoid producing a relative phase shift between the same.

2. Apparatus as claimed in claim 1 comprising first and second parallel shafts respectively supporting said choke and throttle valves, a first plate on said first shaft and including first and second arms, rollers on said arms following respective of said first and second cam plates, a second plate fixed on said first shaft, link means for engaging and turning said second plate, a choke lever on said first shaft and including a first claw, a second claw on said first plate for engaging said first claw, and spring means to urge said claws together.

3. Apparatus as claimed in claim 2 comprising a first lever fixed on said second shaft to rotate the latter, means to displace said lever, a second lever rotatable on said second shaft, a gear rotatable on said second shaft and fixed to said second lever; a pivotable arm including a gear segment in mesh with said gear, shock absorber means adjustably mounted on said second lever, a stop on said first lever to be engaged by said shock absorber means, and a roller on said pivotable arm to engage said third cam plate to displace said gear segment and thereby said gear to bring the shock absorber means against said stop.

4. Apparatus as claimed in claim 3 wherein said shock absorber means includes position adjusting means to adjust the position of the shock absorber means relative to said second lever.

5. Apparatus as claimed in claim 4 comprising gear train means coupled to said prime mover and clutch means coupled to said gear train means, said driving shaft being coupled to said prime mover by said clutch.

6. Apparatus as claimed in claim 5 wherein said prime mover includes a pulse motor coupled to said gear train means.

7. Apparatus as claimed in claim 5 wherein said driving shaft is parallel to said parallel shafts.

8. Apparatus as claimed in claim 5 wherein said phase shift preventing means includes at least one pin extending through said cam plates and displacement detection plate to lock the same together.

9. Apparatus as claimed in claim 5 wherein said phase shift preventing means includes two pins in parallel extending through said cam plates and displacement detection plate to lock the same together.

10. Apparatus as claimed in claim 9 wherein said phase shift preventing means includes collars between and spacing said cam and displacement detection plates, said pins extending through said collars.

11. Apparatus as claimed in claim 1 wherein said phase shift preventing means includes at least one pin extending through said cam plates and displacement detection plate to lock the same together.

12. Apparatus as claimed in claim 1 wherein said phase shift preventing means includes two pins in parallel extending through said cam plates and displacement detection plate to lock the same together.

13. Apparatus as claimed in claim 12 wherein said phase shift preventing means includes collars between and spacing said cam and displacement detection plates, said pins extending through said collars.

14. Apparatus as claimed in claim 13 comprising at least one washer on said driving shaft to lock said pins in position.

15. Apparatus as claimed in claim 13 wherein said pins are parallel to said driving shaft.

16. Apparatus as claimed in claim 15 wherein said pins are diametrically located on opposite sides of said driving shaft.

* * * * *